US009448530B1

(12) United States Patent
Koyama

(10) Patent No.: US 9,448,530 B1
(45) Date of Patent: Sep. 20, 2016

(54) DEVELOPER STORAGE BODY, IMAGE FORMING UNIT AND IMAGE FORMING APPARATUS

(71) Applicant: Oki Data Corporation, Tokyo (JP)

(72) Inventor: Tetsu Koyama, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/857,425

(22) Filed: Sep. 17, 2015

(30) Foreign Application Priority Data

Mar. 20, 2015 (JP) ..... 2015-057716

(51) Int. Cl.
*G03G 15/08* (2006.01)
*G03G 21/16* (2006.01)

(52) U.S. Cl.
CPC ..... *G03G 21/1676* (2013.01); *G03G 21/1647* (2013.01); *G03G 15/0832* (2013.01); *G03G 15/0837* (2013.01); *G03G 2215/0668* (2013.01); *G03G 2215/0692* (2013.01)

(58) Field of Classification Search
CPC ..... G03G 15/08
USPC ..... 399/262
See application file for complete search history.

(56) References Cited

FOREIGN PATENT DOCUMENTS

JP 2003-345116 * 12/2003 ..... G03G 15/08
JP 2003-345116 A 12/2003

* cited by examiner

*Primary Examiner* — David Gray
*Assistant Examiner* — Kevin Butler
(74) *Attorney, Agent, or Firm* — Rabin & Berdo, P.C.

(57) ABSTRACT

A developer storage body includes a first storage member, a second storage member, a frame and a resiliently deformable partition member. The first storage member includes a first opening, and a first flange provided along an outer periphery of the first opening. The second storage member includes a second opening, and a second flange provided along an outer periphery of the second opening so that the second flange faces the first flange. The frame includes a third flange held between the first flange and the second flange. A partition member includes a peripheral end portion fixed to the frame. The partition member and the first storage member form a first space portion therebetween. The partition member and the second storage member form a second space portion therebetween.

20 Claims, 14 Drawing Sheets

DEVELOPER STORAGE BODY, IMAGE FORMING UNIT AND IMAGE FORMING APPARATUS

BACKGROUND OF THE INVENTION

The present invention relates to a developer storage body that stores a developer, and also relates to an image forming unit and an image forming apparatus including the developer storage body.

There is proposed a developer cartridge including a first storage chamber and a second storage chamber partitioned by a partition member. The first storage chamber stores a fresh developer. The second storage chamber stores a waste developer (see, for example, Japanese Patent No. 4086547).

In this regard, there is a demand for a developer storage body (such as a developer cartridge) that is simple in structure and easy to manufacture.

SUMMARY OF THE INVENTION

An aspect of the present invention is intended to provide a developer storage body, an image forming unit and an image forming apparatus which are simple in structure and easy to manufacture.

According to an aspect of the present invention, there is provided a developer storage body includes a first storage member, a second storage member, a frame and a resiliently deformable partition member. The first storage member includes a first opening and a first flange provided along an outer periphery of the first opening. The second storage member includes a second opening and a second flange provided along an outer periphery of the second opening so that the second flange faces the first flange. The frame includes a third flange held between the first flange and the second flange. A partition member includes a peripheral end portion mounted to the frame. The partition member and the first storage member form a first space portion therebetween. The partition member and the second storage member form a second space portion therebetween.

According to another aspect of the present invention, there is provided an image forming unit including the above described developer storage body that stores a developer, an image bearing body that bears a latent image, a developer bearing body that bears a developer and develops the latent image on the image bearing body, and a developer supply member that supplies the developer to the developer bearing body.

According to still another aspect of the present invention, there is provided an image forming apparatus including a medium feeding unit that feeds a medium, and the above described image forming unit that forms an image on the medium fed by the feeding unit.

With such a configuration, it becomes possible to provide a developer storage body, an image forming unit and an image forming apparatus which is small in size and light in weight.

DETAILED DESCRIPTION OF THE PREFERRED EMBODIMENT

Figure 1:
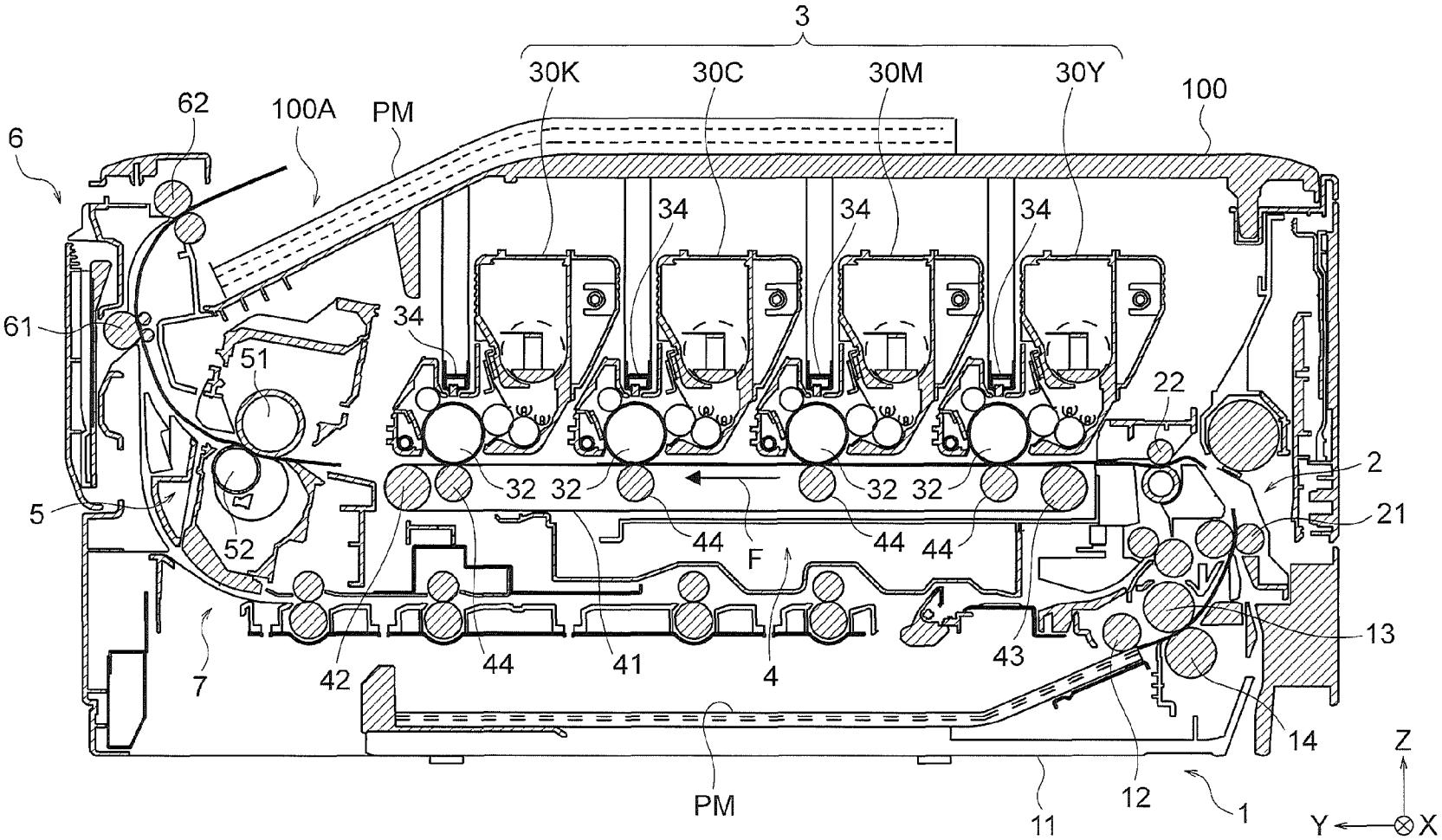
FIG. 1 is a schematic sectional view showing an entire configuration of an image forming apparatus according to the embodiment of the present invention.

Embodiments of the present invention will be described with reference to the attached drawings. In the following description, examples of the present invention will be described, but the present invention is not limited to these examples. Further, the present invention is not limited to arrangements, dimensions, dimensional ratios or the like of respective elements shown in the drawings.

Hereinafter, an image forming apparatus including a toner cartridge (i.e., a developer storage body) according to the embodiment will be first described. Then, a modification, i.e., an example in which a partition member (together with a frame) is held between two storage members will be described.

Embodiment

Configuration of Image Forming Apparatus

FIG. 1 is a schematic sectional view showing an entire configuration of an image forming apparatus according to the embodiment of the present invention. The image forming apparatus is, for example, a printer that forms an image (for example, a color image) using an electrophotography on a medium (i.e., a printing medium) PM such as a paper. The image forming apparatus includes a medium feeding unit 1, a transport unit 2, an image forming section 3, a transfer unit 4, a fixing unit 5, an ejection unit 6, and an inverting unit 7.

These elements are housed in a casing 100. A path along which the medium PM is transported is defined as a transport path. Terms "upstream" and "downstream" are defined with reference to the transport path. To be more specific, the term "upstream" is used to indicate a direction toward (or a position closer to) the medium feeding unit 1 along the transport path. The term "downstream" is used to indicate a direction away from (or a position farther from) the medium feeding unit 1 along the transport path. The term "transport direction F" is used to indicate a direction in which the medium PM is transported along the transport path (i.e., a direction from upstream to downstream). The term "widthwise direction" is used to indicate a direction (parallel to an X direction shown in FIG. 1) parallel to a surface of the medium PM transported along the transport path and perpendicular to the transport direction F. A dimension in the transport direction F will be referred to as a length. A dimension in the widthwise direction will be referred to as a width.

<Medium Feeding Unit 1>

The medium feeding unit 1 is configured to feed the media PM one by one to the transport unit 2. The medium feeding unit 1 includes, for example, a feeding tray 11, a pickup roller 12, a feeding roller 13, and a retard roller 14. The feeding tray 11 stores a stack of a plurality of the media PM. The feeding tray 11 is detachably mounted to, for example, a lower part of the image forming apparatus. The pickup roller 12, the feeding roller 13 and the retard roller 14 rotate to feed the individual medium PM from the feeding tray 11 into the transport path toward the transport unit 2. The pickup roller 12 and the feeding roller 13 are driven under control of a control unit (not shown), and rotate in a direction in which the pickup roller 12 and the feeding roller 13 feed the medium PM toward the transport unit 2. The pickup roller 12 is disposed at a position where the pickup roller 12 contacts an upper surface of the uppermost medium PM of the stack. The feeding roller 13 is disposed downstream of the pickup roller 12. The retard roller 14 prevents two or more media PM from being fed at the same time. The retard roller 14 is disposed at a position facing the feeding roller 13, and rotates in the same rotating direction as a rotating direction of the feeding roller 13 (so that circumferential surfaces of the feeding roller 13 and the retard roller 14 move in opposite directions at a portion where the rollers 13 and 14 face each other).

<Transport Unit 2>

The transport unit 2 is configured to correct a skew of the medium PM fed from the medium feeding unit 1, and transport the medium PM along the transfer path toward the image forming section 3 and the transfer unit 4. The transport unit 2 includes, for example, two pairs of registration rollers 21 and 22.

<Image Forming Section 3>

The image forming section 3 is configured to form an image on the medium PM transported from the transport unit 2.

The image forming section 3 includes, for example, four image forming units (i.e., process units) 30Y, 30M, 30C and 30K as shown in FIG. 1. The image forming units 30Y, 30M, 30C and 30K form toner images (i.e., developer images) using toners T of respective colors, i.e., a yellow toner, a magenta toner, a cyan toner and a black toner. The image forming units 30Y, 30M, 30C and 30K are arranged in this order along the transport direction F.

The image forming units 30Y, 30M, 30C and 30K have the same configuration except for the toners, and therefore are collectively referred to as the "image forming unit 30".

Figure 2:
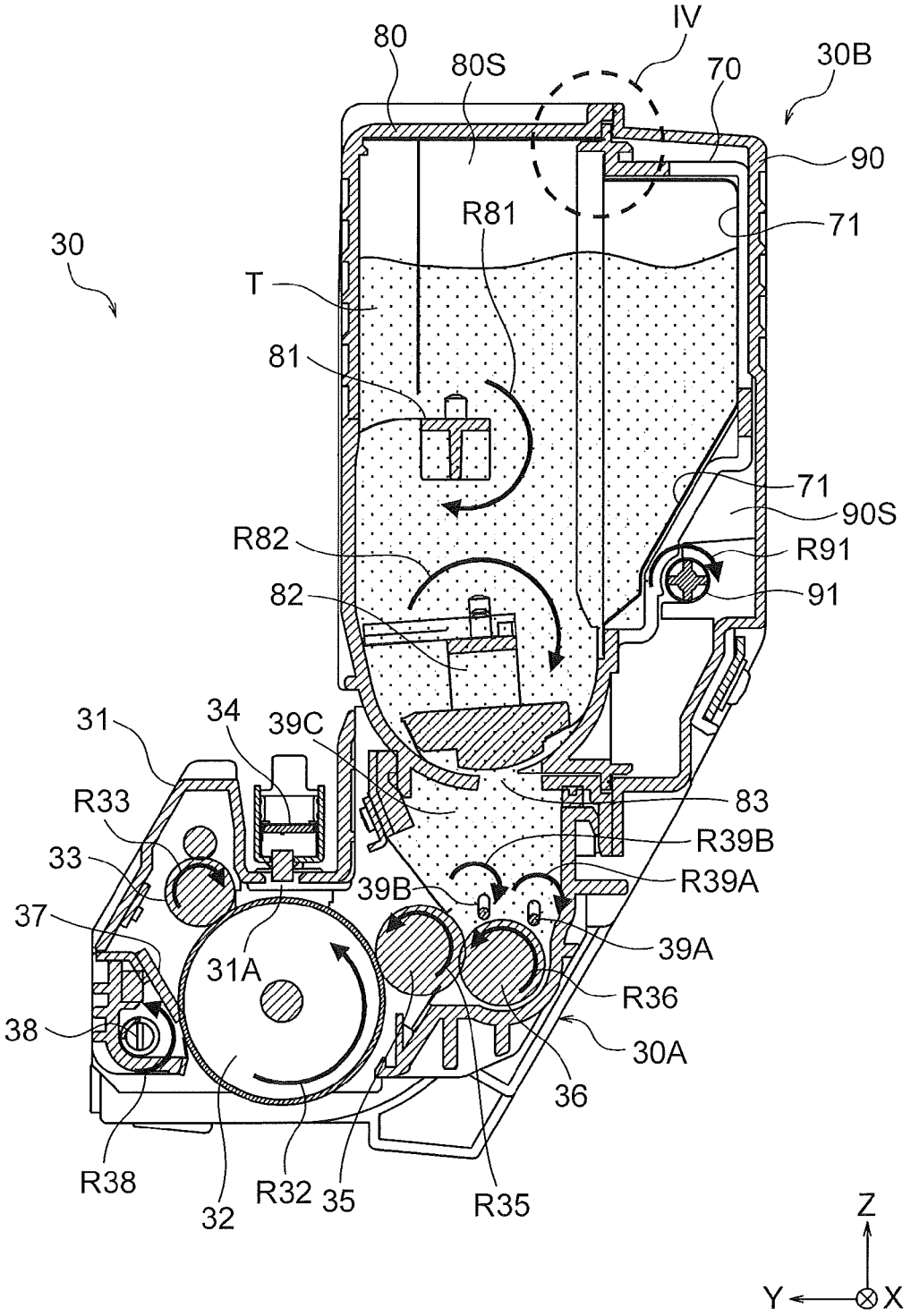
FIG. 2 is a schematic sectional view showing a configuration of an image forming unit of the image forming apparatus shown in FIG. 1.

FIG. 2 is a schematic sectional view showing a configuration of the image forming unit 30 (i.e., each of the image forming units 30Y, 30M, 30C and 30K). Each image forming unit 30 includes, for example, a main body 30A and a toner cartridge 30B (i.e., a developer storage body) disposed at an upper part of the main body 30A as shown in FIG. 2. The main body 30A includes a photosensitive drum 32, a charging roller 33, a developing roller 35, a supply roller 36, a cleaning blade 37, a waste toner conveying member 38 and agitation members 39A and 39B. These elements are enclosed by a cover 31 (i.e., an enclosure) of the main body 30A. An LED (Light Emitting Diode) head 34 is disposed outside the cover 31 so as to face the photosensitive drum 32 via a window 31A. A detailed description of the image forming unit 30 will be made later.

<Transfer Unit 4>

Referring back to FIG. 1, the transfer unit 4 is also referred to as a transfer belt unit. The transfer unit 4 includes a transfer belt 41, a driving roller 42 that rotates to drive the transfer belt 41, a driven roller 43 that rotates following a rotation of the driving roller 42, and transfer rollers 44 (i.e., transfer members) provided so as to face the photosensitive drums 32 via the transfer belt 41. The driving roller 42 and the driven roller 43 are cylindrical members respectively rotatable about rotation shafts extending in the widthwise direction. The transfer unit 4 transports the medium PM (having been fed from the transport unit 2) in the transport direction F, and transfers the toner images from the photosensitive drums 32 of the image forming units 30Y, 30M, 30C and 30K to the surface of the medium PM.

The transfer belt 41 is an endless resilient belt composed of, for example, resin material such as polyimide resin. The transfer belt 41 is stretched around the driving roller 42 and the driven roller 43. The driving roller 42 is driven by a motor (not shown) under control of the control unit (not shown), and rotates in a direction in which the transfer belt 41 transports the medium PM in the transport direction F. The driving roller 42 is disposed downstream of the image forming units 30Y, 30M, 30C and 30K. The driven roller 43 is biased by a biasing member (not shown), and applies a tension to the transfer belt 41. The driven roller 43 rotates in the same rotating direction as the driving roller 42. The driven roller 43 is disposed upstream of the image forming units 30Y, 30M, 30C and 30K.

The transfer rollers 44 rotate in a rotating direction opposite to a rotating direction of the photosensitive drums 32 of the image forming units 30Y, 30M, 30C and 30K, and transport the medium PM in the transport direction F. Further, the transfer rollers 44 electrostatically transfer the toner images from the photosensitive drums 32 to the medium PM. Each of the transfer rollers 44 is formed of, for example, a foamed semiconductive rubber.

<Fixing Unit 5>

The fixing unit 5 is configured to fix the toner image (having been transferred to the medium PM by the transfer unit 4) to the medium PM by applying heat and pressure thereto. The fixing unit 5 includes, for example, an upper roller 51 and a lower roller 52.

Each of the upper roller 51 and the lower roller 52 include a heater (for example, a halogen lamp) as an internal heat source, and functions as a heating roller that applies heat to the toner image on the medium PM. The upper roller 51 is driven under control of the control unit (not shown), and rotates in a direction in which the upper roller 51 transports the medium PM in the transport direction F. The heaters provided in the upper roller 51 and the lower roller 52 are applied with bias voltages controlled by the control unit, and surface temperatures of the upper roller 51 and the lower roller 52 are controlled by the control unit. The lower roller 52 is provided facing the upper roller 51 so as to form a nip portion therebetween. The lower roller 52 functions as a pressure roller that applies a pressure to the toner image on the medium PM. The lower roller 52 preferably has a surface layer composed of resilient (elastic) material.

<Ejection Unit 6>

The ejection unit 6 is configured to eject the medium PM (to which the toner image has been fixed by the fixing unit 5) to outside. The ejection unit 6 includes, for example, two pairs of transport roller 61 and 62. The transport rollers 61 and 62 transport the medium PM through the transport path, and eject the medium PM to outside. The ejected medium PM is placed on a stacker 100A provided outside the casing 100. The transport rollers 61 and 62 are driven under control of the control unit, and rotate in a direction in which the transport rollers 61 and 62 transport the medium PM in the transport direction F.

<Inverting Unit 7>

The inverting unit 7 inverts the medium PM (having passed the fixing unit 5) upside-down, and transports the medium PM back to the transport unit 2. The medium PM transported by the inverting unit 7 reaches the transport unit 2, and is further transported through the image forming section 3 and the transfer unit 4 in such an orientation that a printed surface (i.e., a surface on which the toner image has been formed) faces downward. In other words, the inverting unit 7 enables the image forming apparatus to perform a duplex printing.

<Image Forming Unit 30>

Configurations of the image forming unit 30 (i.e., each of the image forming units 30Y, 30M, 30C and 30K) will be described in detail with reference to FIG. 2.

In the image forming unit 30, the photosensitive drum 32 (i.e., an image bearing body) is a cylindrical member having a surface layer capable of bearing a latent image. The surface layer is composed of a photosensitive body (for example, an organic photosensitive body). To be more specific, the photosensitive drum 32 includes a conductive support and a photoconductive layer covering a circumferential surface of the conductive support. The conductive support is formed of, for example, a metal pipe of aluminum. The photoconductive layer has, for example, a layered structure including a charge generation layer and a charge transport layer. The photosensitive drum 32 is driven under control of the control unit, and rotates at a predetermined circumferential speed in a direction (shown by an arrow R32 in FIG. 2) in which the photosensitive drum 32 transports the medium PM in the transport direction F.

The charging roller 33 (i.e., a charging member) is configured to uniformly charge a surface (i.e., a circumferential surface, or the above described surface layer) of the photosensitive drum 32. The charging roller 33 contacts the surface of the photosensitive drum 32. The charging roller 33 includes, for example, a metal shaft and a semiconductive rubber layer (for example, a semiconductive epichlorohydrin rubber layer) covering a circumferential surface of the metal shaft. The charging roller 33 is driven under control of the control unit, and rotates in a direction (shown by an arrow R33) opposite to a rotating direction of the photosensitive drum 32.

The LED head 34 (i.e., an exposing device) is configured to form an electrostatic latent image on the surface (i.e., the surface layer) of the photosensitive drum 32 by exposing the surface of the photosensitive drum 32. The LED head 34 includes, for example, a plurality of LED elements (i.e., light emission elements) arranged in the widthwise direction and facing the photosensitive drum 32, and a lens array that focus light beams (emitted by the LED elements) on the surface of the photosensitive drum 32.

The developing roller 35 (i.e., a developer bearing body) is configured to bear a toner T as a developer on a surface thereof for developing the latent image. The developing roller 35 is disposed so as to contact the surface of the photosensitive drum 32. The developing roller 35 includes, for example, a metal shaft and a semiconductive urethane rubber layer covering a circumferential surface of the metal shaft. The developing roller 35 is driven under control of the control unit, and rotates at a predetermined circumferential speed in the same rotating direction (shown by an arrow R35 in FIG. 2) as the rotating direction of the photosensitive drum 32.

The supply roller 36 (i.e., a supply member) is configured to supply the toner T to the developing roller 35. The supply roller 36 is disposed so as to contact a circumferential surface of the developing roller 35. The supply roller 36 includes, for example, a metal shaft and a foamed silicone-rubber layer covering a circumferential surface of the metal layer. The supply roller 36 is driven under control of the control unit, and rotates in the same rotating direction (shown by an arrow R36 in FIG. 2) as the rotating direction of the developing roller 35.

The cleaning blade 37 (i.e., a cleaning member) is configured to scrape off the toner T remaining on the surface of the photosensitive drum 32. The cleaning blade 37 is formed of, for example, material having flexibility such as rubber or plastic.

The waste toner conveying member 38 (i.e., a waste developer conveying member) is driven under control of the control unit, and conveys the toner T (hereinafter referred to as a waste toner T2) scraped off by the cleaning blade 37. The waste toner conveying member 38 conveys the waste toner T2 by rotating, for example, in a direction shown by an arrow R38 in FIG. 2. The waste toner conveying member 38 conveys the waste toner T2 to a waste toner storage chamber 90S provided in the toner cartridge 30B.

The toner cartridge 30B includes a toner storage chamber 80S storing the toner T of one of the above described four colors. To be more specific, the toner cartridge 30B of the image forming unit 30Y stores the yellow toner. The toner cartridge 30B of the image forming unit 30M stores the magenta toner. The toner cartridge 30B of the image forming unit 30C stores the cyan toner. The toner cartridge 30B of the image forming unit 30K stores the black toner. An agitation member 81 and an agitation shutter member 82 are provided in the toner cartridge 30B. The agitation member 81 and the agitation shutter member 82 agitate the toner T by rotating in directions respectively shown by arrows R81 and R82 in FIG. 2. A toner supply opening 83 is formed on a bottom of the toner cartridge 30B. The toner supply opening 83 allows the toner T to be supplied to a toner agitation chamber 39C (i.e., a developer reservoir) provided below the toner cartridge 30B. In this regard, the agitation shutter member 82 also functions as a shutter that opens and closes the toner supply opening 83 by rotating in the direction shown by the arrow R82 in FIG. 2. In the toner agitation chamber 39C, the agitation members 39A and 39B are disposed in the vicinity of the supply roller 36. The agitation members 39A and 39B agitate the toner T supplied from the toner cartridge 30B by rotating in directions respectively shown by arrows R39A and R39B in FIG. 2.

In this regard, the toner cartridge 30B may be formed integrally with the main body 30A. Alternatively, the toner cartridge 30B may be formed separately from the main body 30A, and may be configured to be detachably mounted to the main body 30A.

<Configuration of Toner Cartridge 30A>

Figure 3:
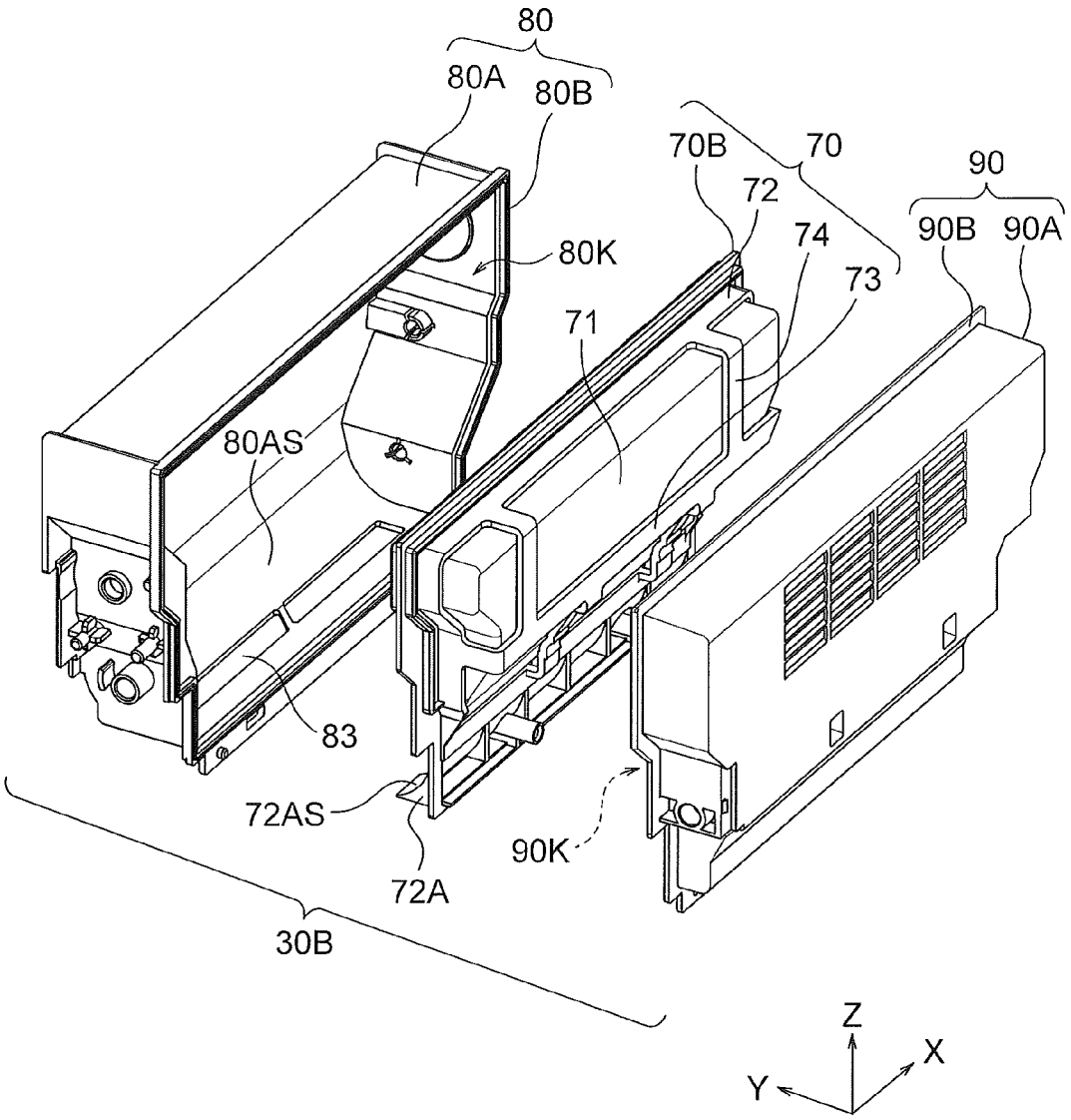
FIG. 3 is an exploded perspective view showing a toner cartridge of the image forming unit shown in FIG. 2.
Figure 4:
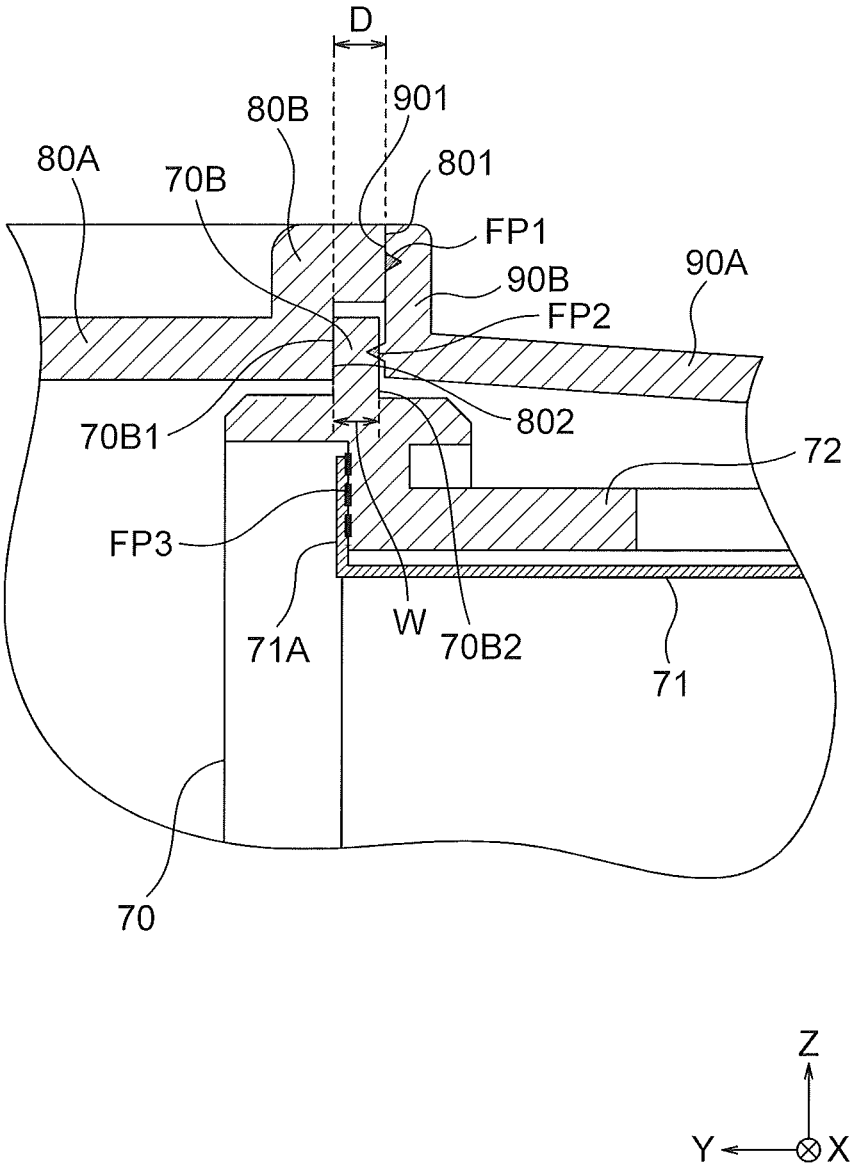
FIG. 4 is an enlarged sectional view showing a part of the image forming unit indicated by a circle IV in FIG. 2.
Figure 5:
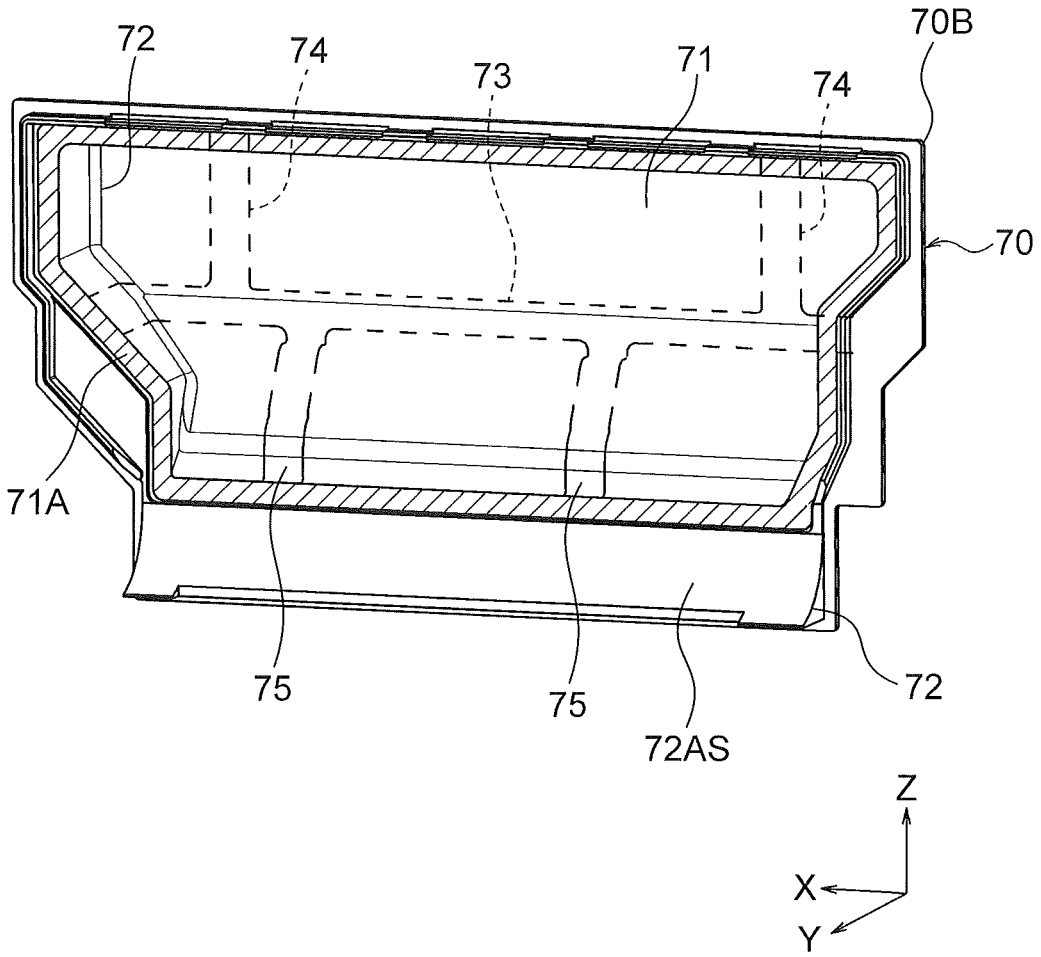
FIG. 5 is a perspective view showing a frame and a partition member of the toner cartridge shown in FIG. 3.
Figure 6:
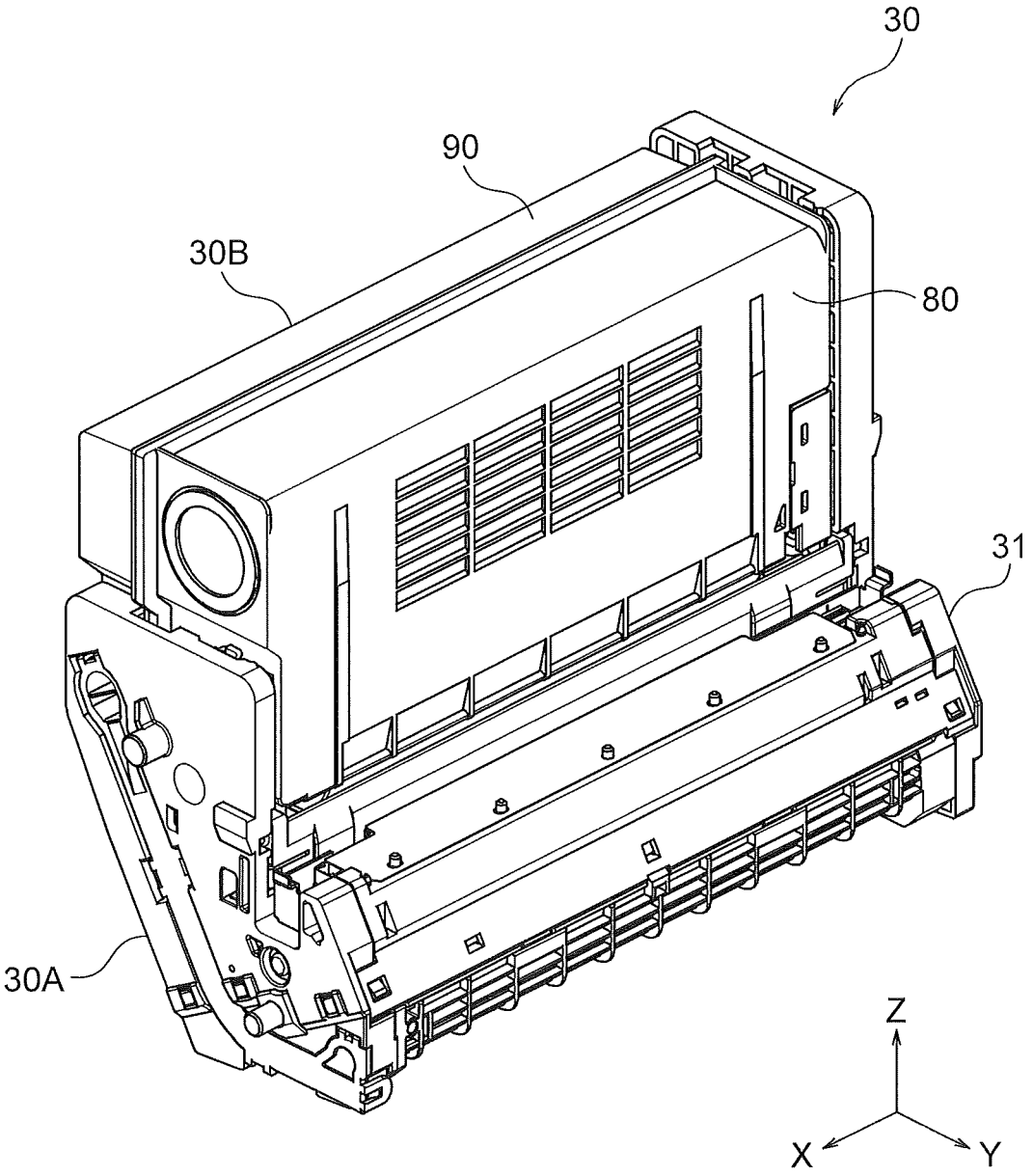
FIG. 6 is a perspective view showing an external configuration of the image forming unit shown in FIG. 2.
Figure 7:
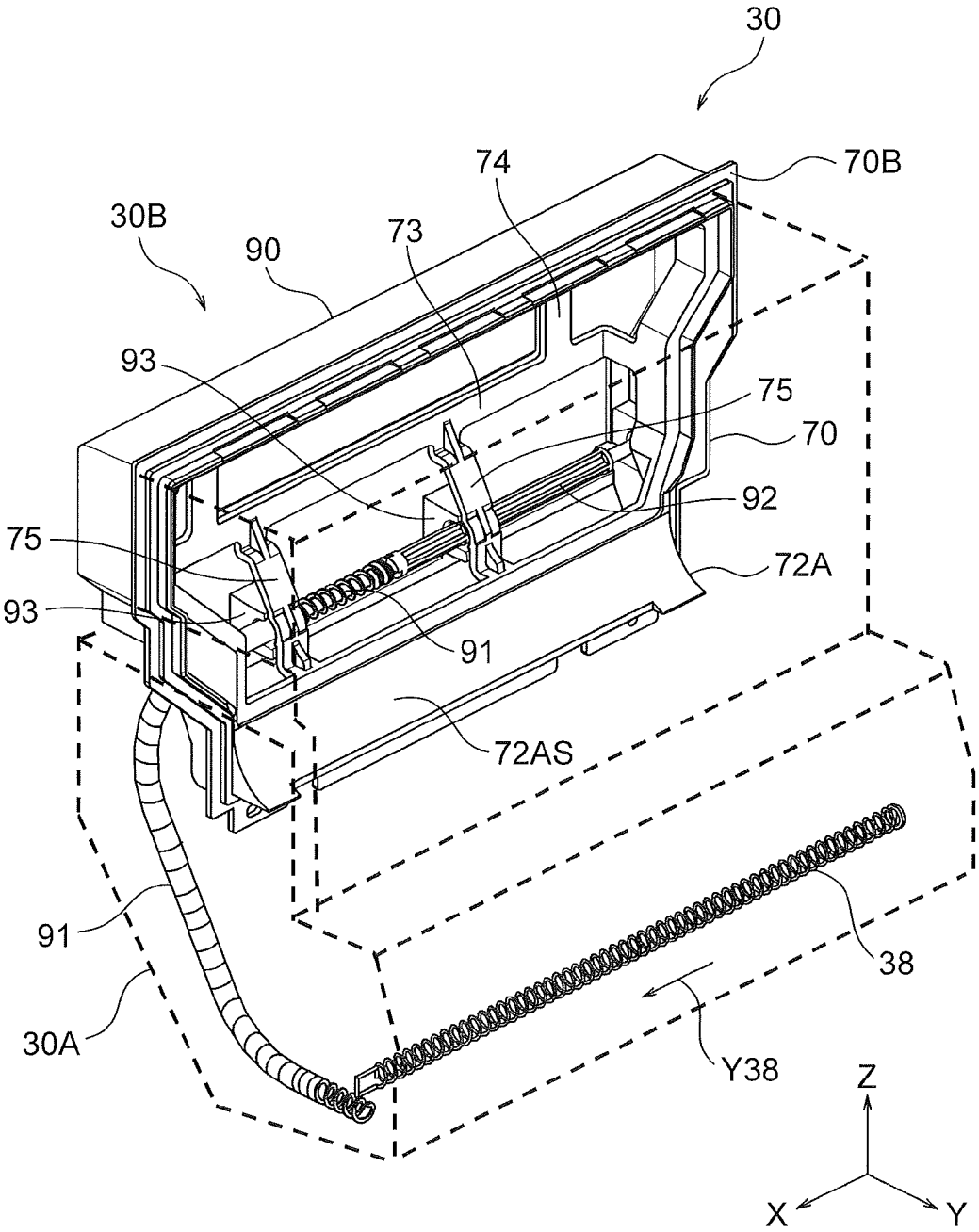
FIG. 7 is a partially cutaway perspective view showing an internal configuration of the image forming unit shown in FIG. 6.
Figure 8:
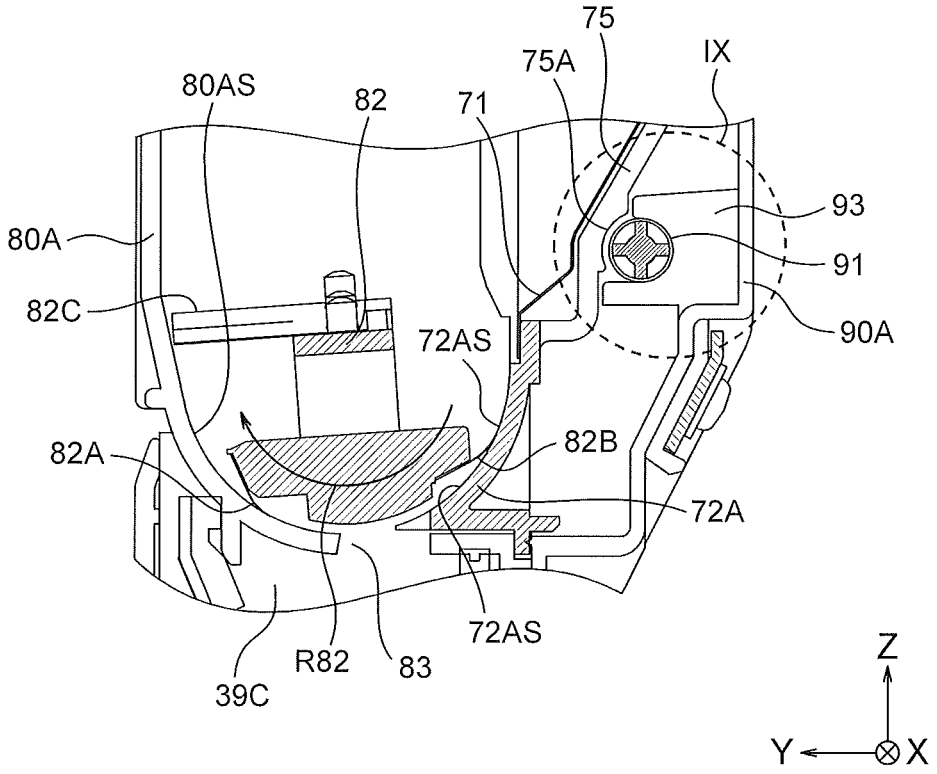
FIG. 8 is an enlarged sectional view showing a part of the image forming unit shown in FIG. 2.
Figure 9:
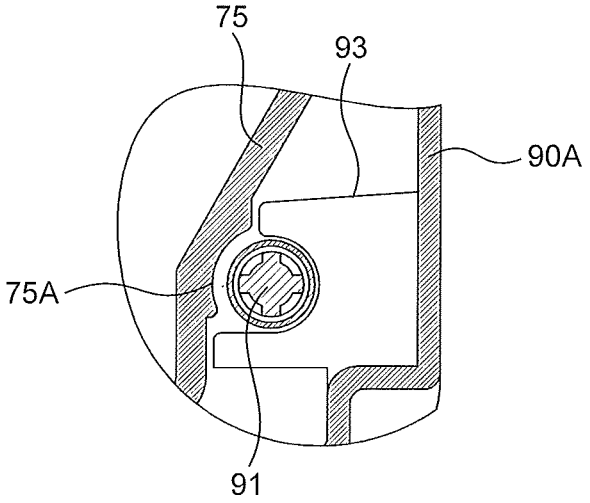
FIG. 9 is an enlarged sectional view showing a part of the image forming unit indicated by a circle IX in FIG. 8.
Figure 10:
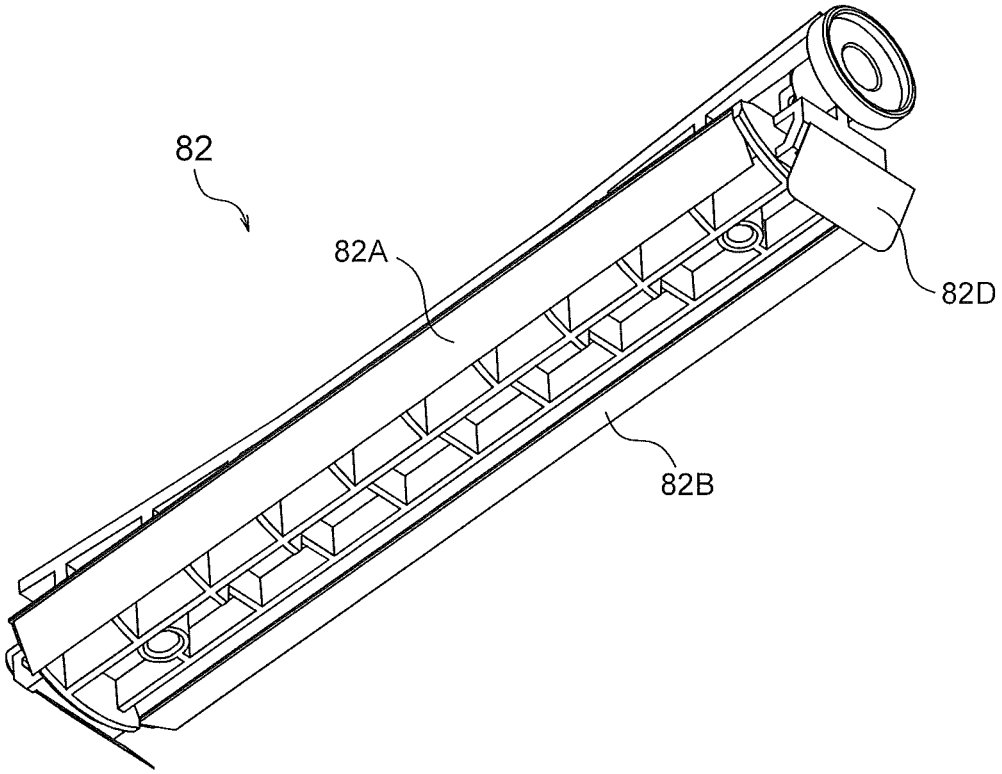
FIG. 10 is a perspective view showing an agitation shutter member of the image forming unit shown in FIG. 2.
Figure 11:
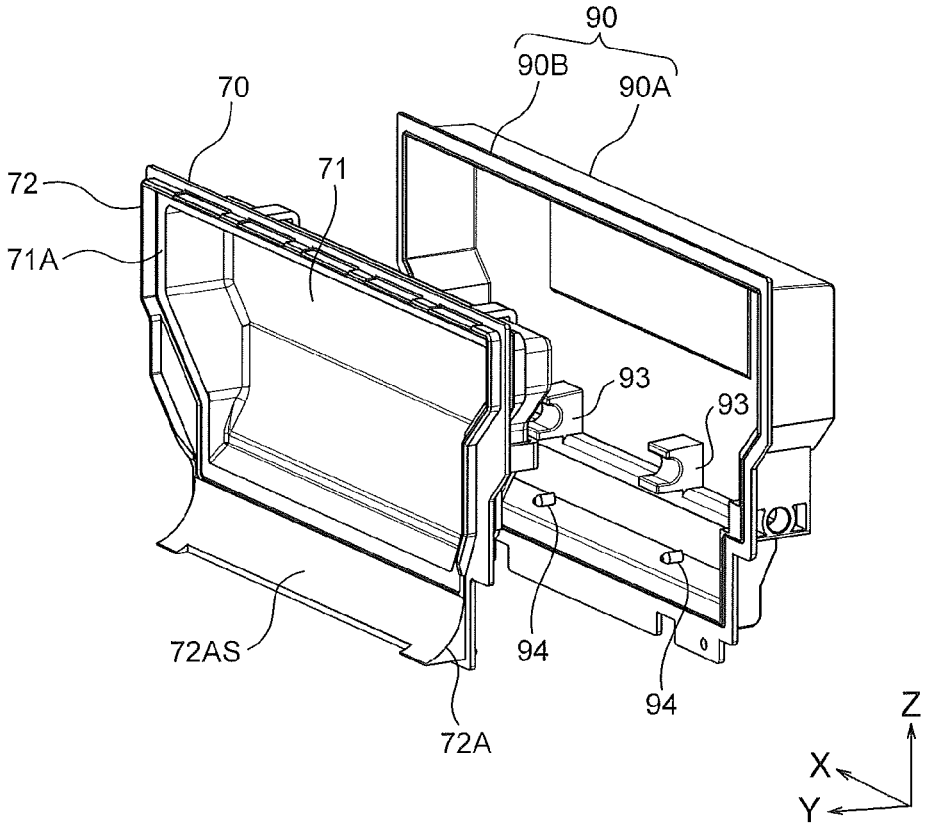
FIG. 11 is an exploded perspective view showing components of the toner cartridge shown in FIG. 3.
Figure 12:
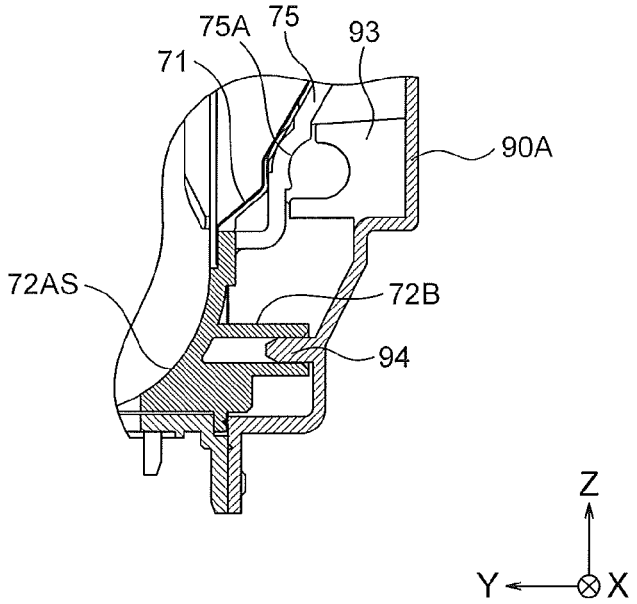
FIG. 12 is an enlarged sectional view showing a part of the toner cartridge shown in FIG. 3.

Next, a configuration of the toner cartridge 30B will be described with reference to FIG. 2 through 17. FIG. 3 is an exploded perspective view showing main components of the toner cartridge 30B. FIG. 4 is a sectional view showing a part indicated by a circle IV (shown by a dashed line) in FIG. 2. FIG. 5 is a perspective view showing outer shapes of a frame 70 and a partition member 71 described later. FIG. 6 is a perspective view showing an external configuration of the image forming unit 30 including the toner cartridge 30B. FIG. 7 is a partially cutaway perspective view showing an internal configuration of the image forming unit 30. FIG. 8 is an enlarged sectional view showing a lower part of the toner cartridge 30B. FIG. 9 is an enlarged sectional view showing a part indicated by a circle IX (shown by a dashed line) in FIG. 8. FIG. 10 is a perspective view showing an outer shape of the agitation shutter member 82. FIG. 11 is an exploded perspective view showing outer shapes of the frame 70 and a storage member 90 (described later) of the toner cartridge 30B. FIG. 12 is an enlarged sectional view showing a connecting portion between the frame 70 and the storage member 90.

As shown in FIG. 3, the toner cartridge 30B includes the storage member 80 (i.e., a first storage member), the storage member 90 (i.e., a second storage member), the frame 70, and the partition member 71. The frame 70 is held between the storage member 80 and the storage member 90. The partition member 71 has a peripheral end portion 71A fixed to an outer frame 72 (described later) of the frame 70. The partition member 71 is resiliently deformable.

The storage member 80 includes a main body 80A (i.e., a first main body) having an opening 80K (i.e., a first opening), and a flange 80B (i.e., a first flange) provided along an outer periphery of the opening 80K. The flange 80B extends so as to surround the opening 80K. The storage member 90 includes a main body 90A (i.e., a second main body) having an opening 90K (i.e., a second opening), and a flange 90B (i.e., a second flange) provided along the outer periphery of the opening 90K so as to face the flange 80B. The flange 90B extends so as to surround the opening 90K. The frame 70 includes the outer frame 72 and a flange 70B (i.e., a third flange) provided along an outer periphery of the outer frame 72. The flange 70B extends so as to surround the outer frame 72. The flange 70B protrudes outward from the outer frame 72. The frame 70 is formed of resin such as, for example, high density polyethylene (HDPE) that has a higher hardness than the partition member 71.

As shown in FIG. 4, the flange 70B is held (sandwiched) between the flange 80B and the flange 90B. The flange 80B has a step portion including a surface 801 that contacts the flange 90B, and a surface 802 retracted from the surface 801 by a distance D. The surface 802 of the flange 80B contacts a surface 70B1 of the flange 70B. The flange 90B includes a surface 901 that contacts the surface 801 of the flange 80B. The surface 901 of the flange 90B faces the surface 802 of the flange 80B with a gap of the distance D. The flange 70B is disposed between the surface 901 of the flange 90B and the surface 802 of the flange 80B.

A fixing portion FP1 is formed between the surface 801 of the flange 80B and the surface 901 of the flange 90B. The surface 801 of the flange 80B and the surface 901 of the flange 90B are tightly fixed to each other at the fixing portion FP1 by heat welding, ultrasonic welding or the like. Further, a fixing portion FP2 is formed between a surface 70B2 of the flange 70B and the surface 901 of the flange 90B. It is preferable that the surface 70B2 of the flange 70B and the surface 901 of the flange 90B are tightly fixed to each other at the fixing portion FP2 by heat welding, ultrasonic welding, or the like. In this regard, it is preferable that a width W (FIG. 4) of the flange 70B is substantially the same as or slightly smaller than the distance D. This is because the flange 80B and the flange 90B can be firmly fixed to each other, and the flange 70B can be sufficiently fixed by being held between the flange 80B and the flange 90B. Further, this is because the fixing portion FP1 and the fixing portion FP2 can be formed at the same time in a manufacturing process.

The partition member 71 includes the peripheral end portion 71A fixed to the outer frame 72 of the frame 70 (FIGS. 4 and 5). The partition member 71 partitions an inner space of the toner cartridge 30B (formed by the storage member 80 and the storage member 90) into two chambers, i.e., a toner storage chamber 80S (i.e., a first space portion) and a waste toner storage chamber 90S (i.e., a second space portion) as shown in FIG. 2. To be more specific, the toner storage chamber 80S is formed between the partition member 71 and the storage member 80. The waste toner storage chamber 90S is formed between the partition member 71 and the storage member 90. The partition member 71 resiliently deforms according to a volume of the toner T stored in the toner storage chamber 80S, and a volume of the waste toner T2 stored in the waste toner storage chamber 90S. The partition member 71 is formed of, for example, a film composed of resin which is softer than the frame 70. The partition member 71 is preferably formed of a film of low-density-polyethylene (LDPE) having a thickness in a range approximately from 0.1 mm to 0.4 mm. The peripheral end portion 71A of the partition member 71 is fixed to the outer frame 72 at a fixing portion FP3 by heat welding, bonding material or the like. Since the peripheral end portion 71A is fixed to the outer frame 72 (i.e., a part of the frame 70 different from the flange 70B), gaps between any two of the flange 70B, the flange 80B and the flange 90B can be minimized.

The frame 70 further includes a beam 73, ribs 74 and ribs 75 as shown in FIGS. 3, 4 and 5. The beam 73 extends in the widthwise direction and crosses a space surrounded by the outer frame 72. The ribs 74 extend to connect an upper part of the outer frame 72 with the beam 73. The ribs 75 extend to connect a lower part of the outer frame 72 with the beam 73. The outer frame 72, the beam 73 and the ribs 74 have shapes along an inner surface of the main body 90A of the storage member 90. In contrast, the ribs 75 are distanced from the inner surface of the main body 90A of the storage member 90. The number of the beam 73 may be one, two or more. The number of the ribs 74 may be one, two or more. The number of the ribs 75 may be one, two or more. The frame 70 does not have a single plate shape, but has a skeleton structure (i.e., a framework structure) including the outer frame 72, the beam 73 and the ribs 74 and 75. Therefore, the frame 70 can be light in weight and have a strength.

A waste toner conveying member 91 (i.e., a waste developer conveying member) and a driving member 92 are provided between the ribs 75 of the frame 70 and the main body 90A of the storage member 90 (FIGS. 7 through 9). The waste toner conveying member 91 extends in the widthwise direction (i.e., the X direction). The driving member 92 is provided for driving the waste toner conveying member 91. The waste toner conveying member 91 and the driving member 92 are rotatably supported by holding portions 93 and holding portions 75A. The holding portions 93 are provided on an inner surface of the main body 90A of the storage member 90. The holding portions 75A (FIG. 9) are provided on outer surfaces of the ribs 75 of the frame 70. An end of the waste toner conveying member 91 is connected to the driving member 92. The waste toner conveying member 91 further extends to reach a lower part of the main body 30A, and the other end of the waste toner conveying member 91 is connected to the waste toner conveying member 38. The waste toner conveying member 38 extends in the widthwise direction in the lower part of the main body 30A (FIG. 7).

Moreover, the frame 70 further includes a partition portion 72A formed at a lower part of the outer frame 72. The partition portion 72A has a curved inner surface 72AS (FIGS. 7 and 8). The toner supply opening 83 is formed by the partition portion 72A and the main body 80A of the storage member 80.

The agitation shutter member 82 is disposed at a lower part in the toner storage chamber 80S (FIGS. 2, 8 and 10). The agitation shutter member 82 includes films 82A, 82B, 82C and 82D as shown in FIGS. 8 and 10. According to a rotational position of the agitation shutter member 82, the films 82A, 82B, 82C and 82D contact an inner surface 80AS of the main body 80A and the inner surface 72AS of the partition portion 72A so as to prevent an excessive amount of the toner T from falling into the toner agitation chamber 39C via the toner supply opening 83.

Further, when the agitation shutter member 82 rotates in the direction shown by the arrow R82, the films 82A, 82B, 82C and 82D sweep the inner surfaces 80AS and 72AS, and scrape off the toner T adhering to the inner surfaces 80AS and 72AS. Therefore, the toner T is supplied to the toner agitation chamber 39C via the toner supply opening 83.

Further, as shown in FIGS. 11 and 12, the partition portion 72A of the frame 70 is preferably connected to a lower part of the storage member 90. To be more specific, cylindrical portions having cylindrical holes 72B protrude from the partition portion 72A in a direction opposite to the inner surface 72AS. Posts 94 protrude from a lower part of the inner surface of the main body 90A, and engage the holes 72B. With the engagement between the posts 94 and the holes 72B, the frame 70 is firmly fixed to the storage member 90. Therefore, for example, the waste toner conveying member 91 is stably supported, and the waste toner T2 is stably conveyed.

<Operation and Function>

<Image Forming Operation>

The image forming apparatus of this embodiment forms a toner image on the medium PM as described below.

In a state where the image forming apparatus is powered ON, when the control unit (not shown) of the image forming apparatus receives a print command and print image data from a host device such as a personal computer, the control unit starts a printing operation (i.e., an image forming operation) of the print image data according to the print command.

For example, as shown in FIG. 1, the pickup roller 12 rotates to pick up the uppermost medium PM of the media PM stored in the feeding tray 11. The feeding roller 13 and the retard roller 14 feed the individual medium PM into the transport path toward the transport unit 2. In the transport unit 2, the registration rollers 21 correct the skew of the medium PM, and transport the medium PM downstream along the transport path. Further, the registration rollers 22 transport the medium PM toward the image forming section 3 and the transfer unit 4. Then, the medium PM is transported by the transfer belt 41 of the transfer unit 4, and passes the image forming units 30Y, 30M, 30C and 30K of the image forming section 3.

In the image forming units 30 (i.e., in each of the image forming units 30Y, 30M, 30C and 30K), a toner image is formed by an electrophotographic process as described below. The control unit causes the agitation member 81 and the agitation shutter member 82 to rotate in directions respectively shown by the arrows R81 and R82. As the agitation member 81 and the agitation shutter member 82 rotate, the toner T stored in the toner storage chamber 80S is agitated, and is supplied to the toner agitation chamber 39C via the toner supply opening 83.

Further, the control unit causes the photosensitive drum 32 to rotate, for example, in the direction shown by the arrow R32 (FIG. 2) at a constant circumferential speed. A rotation of the photosensitive drum 32 is transmitted to the agitation members 39A and 39B, the supply roller 36, the developing roller 35, and the charging roller 33 via a power transmission mechanism such as a gear train. Therefore, the agitation members 39A and 39B, the supply roller 36, the developing roller 35 and the charging roller 33 respectively rotate in directions shown by the arrows R39A, R39B, R36, R35 and R33 in FIG. 1.

The control unit applies a predetermined voltage to the charging roller 33, and uniformly charges the surface of the photosensitive drum 32. Then, the control unit causes the LED head 34 to emit light based on a color component of the print image data so as to expose the surface of the photosensitive drum 32. Therefore, an electrostatic latent image is formed on the surface of the photosensitive drum 32.

The toner T agitated by the agitation members 39A and 39B is supplied to the developing roller 35 via the supply roller 36. The developing roller 35 bears the toner T on the surface thereof, and makes the toner T adhere to the latent image on the photosensitive drum 32 to form the toner image. Further, the transfer roller 44 of the transfer unit 4 is applied with a predetermined voltage, and an electric field occurs between the photosensitive drum 32 and the transfer roller 44. With the electric field, the toner image is transferred from the photosensitive drum 32 to the medium PM transported through between the photosensitive drum 32 and the transfer roller 44.

After the toner images formed in the image forming units 30Y, 30M, 30C and 30K are transferred to the medium PM, the medium PM is transferred by the transfer belt 41 to the fixing unit 5.

The fixing unit 5 applies heat and pressure to the toner image (having been transferred to the medium PM) to fix the toner image to the medium PM. The ejection unit 6 ejects the medium PM with the fixed toner image to the stacker 100A outside the image forming apparatus.

<Recovery Operation of Waste Toner T2>

Figure 13:
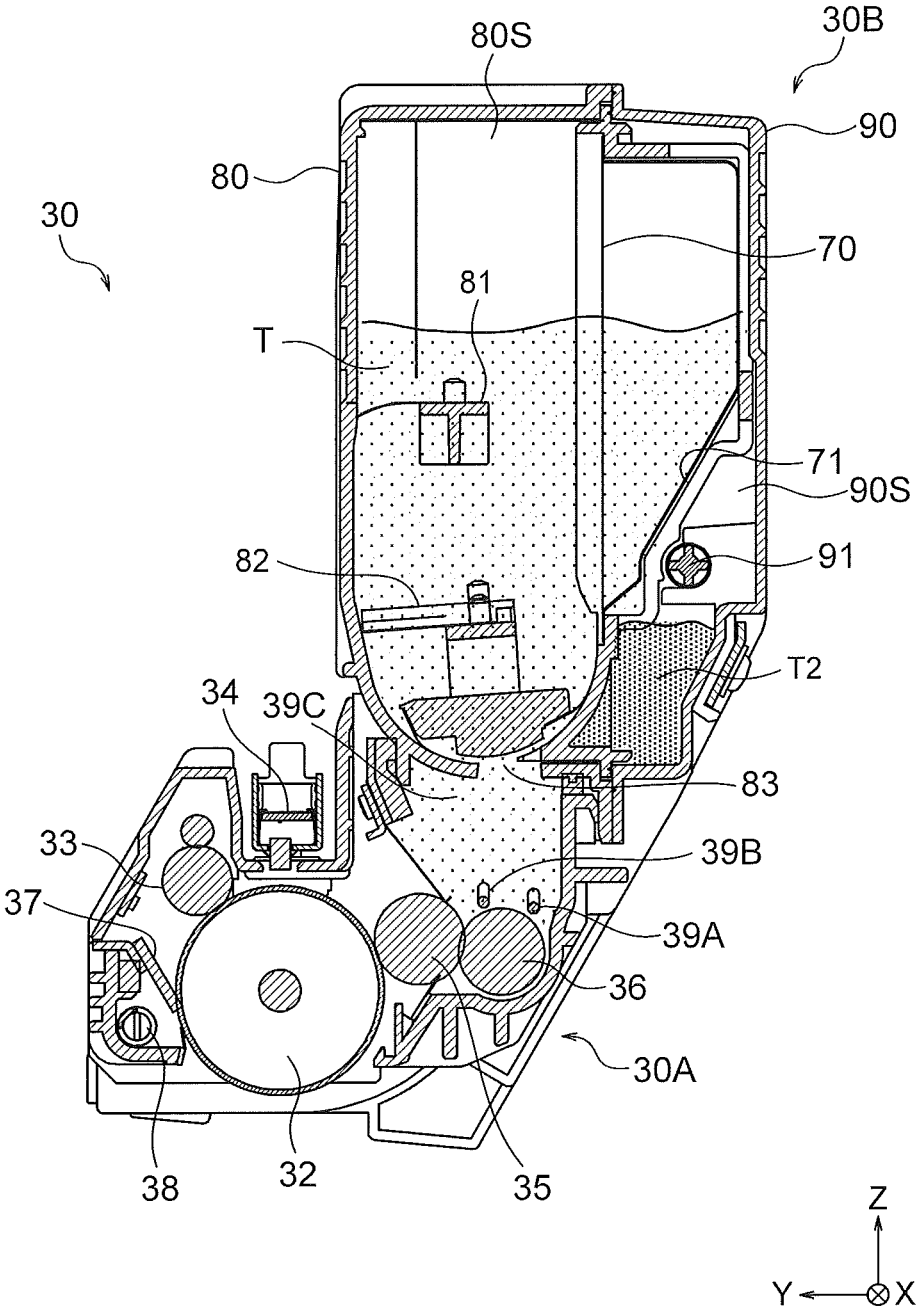
FIG. 13 is a sectional view showing a state of the toner cartridge of the embodiment just after a waste toner recovery operation is started.

A recovery operation of the waste toner T2 in the image forming unit 30 of this embodiment will be described with reference to FIGS. 2, 7 and 13 through 17. In the image forming unit 30, after the toner image on the photosensitive drum 32 is transferred to the medium PM, the toner T remaining on the photosensitive drum 32 is scraped off by the cleaning blade 37. The toner T (i.e., the waste toner T2) scraped off by the cleaning blade 37 is eventually stored in the waste toner storage chamber 90S as shown in FIG. 13. In this regard, FIG. 13 shows a state (i.e., an initial state) where a large amount of the toner T (i.e., a fresh toner) remains in the toner storage chamber 80S, and a small amount of the waste toner T2 is stored in the waste toner storage chamber 90S.

Figure 14:
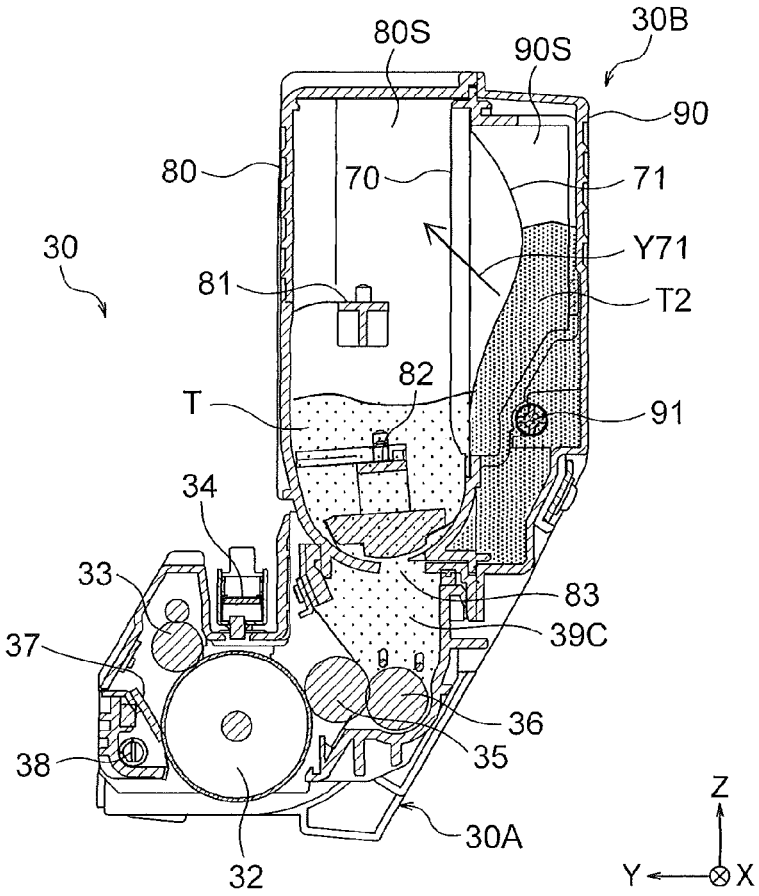
FIG. 14 is a sectional view showing a state of the toner cartridge of the embodiment when the partition member deforms after the waste toner recovery operation is started.
Figure 15:
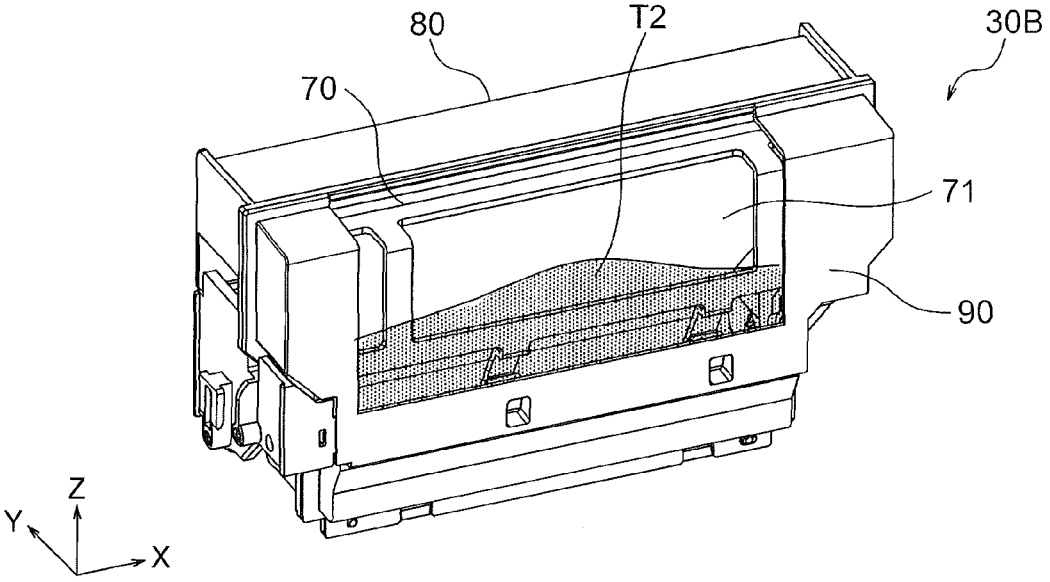
FIG. 15 is a partially cutaway perspective view showing the toner cartridge in the state shown in FIG. 14.

The waste toner T2 scraped off by the cleaning blade 37 is first conveyed in the direction shown by an arrow Y38 in FIG. 7 by the rotation of the waste toner conveying member 38 in a direction shown by the arrow R38 (FIG. 2). Then, the waste toner T2 is conveyed to the waste toner storage chamber 90S by a rotation of the waste toner conveying member 91 (rotated by the driving member 92) in a direction shown by an arrow R91 (FIG. 2). The waste toner T2 is gradually deposited starting from the bottom of waste toner storage chamber 90S. As a number of printed media PM increases, an amount of the toner T (i.e., the fresh toner) decrease, and an amount of the waste toner T2 increases. As a result, the partition member 71 resiliently deforms as shown in FIGS. 14 and 15. FIG. 14 is a schematic sectional view of the image forming unit 30 and FIG. 15 is a partially cutaway perspective view of the toner cartridge 30B in a state where the partition member 71 deforms. The partition member 71 deforms, for example, in a direction shown by an arrow Y71 in FIG. 14 according to the volume of the toner T stored in the toner storage chamber 80S and the volume of the waste toner T2 stored in the waste toner storage chamber 90S. Therefore, a capacity of the toner storage chamber 80S decreases, and a capacity of the waste toner storage chamber 90S increases.

Figure 16:
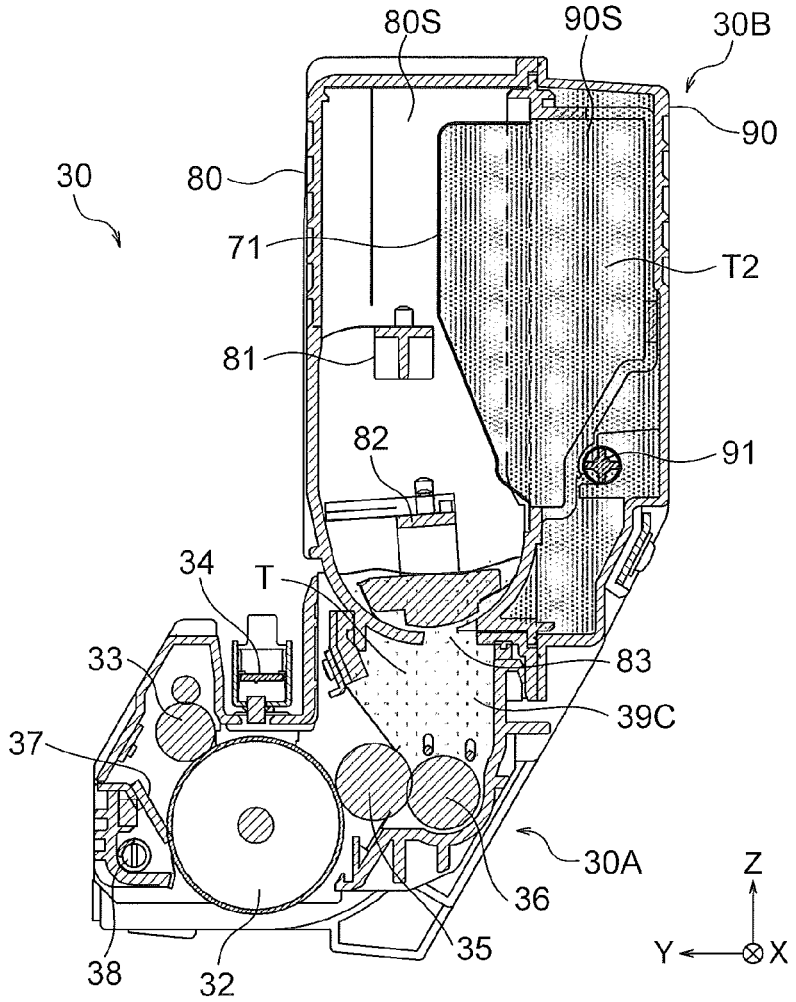
FIG. 16 is a sectional view showing a state of the toner cartridge when a replacement time is reached.
Figure 17:
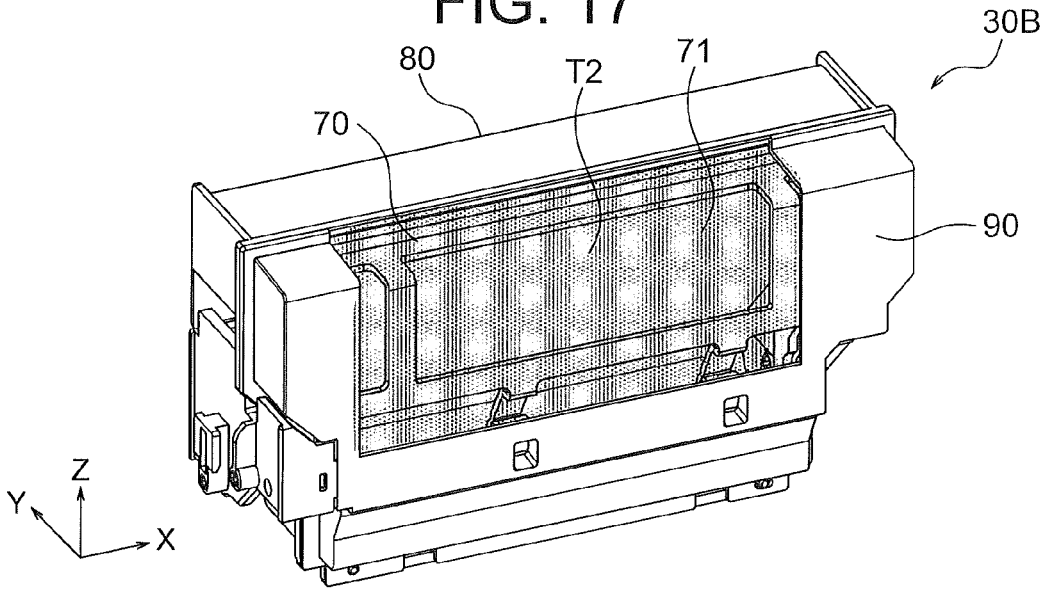
FIG. 17 is a partially cutaway perspective view showing the toner cartridge in the state shown in FIG. 16.

Eventually, as shown in FIGS. 16 and 17, the partition member 71 deforms to a state where the partition member 71 greatly protrudes into inside of the storage member 80 across a border of the storage member 80 and the storage member 90 where the frame 70 is disposed. FIG. 16 is a schematic sectional view of the image forming unit 30 and FIG. 17 is a partially cutaway perspective view of the toner cartridge 30B in a state where the toner T is completely ejected, and the waste toner storage chamber 90S is almost filled with the waste toner T2. That is, FIGS. 16 and 17 show the state where a replacement time of the toner cartridge 30B is reached.

Effects of Embodiment

The toner cartridge 30B of this embodiment includes the storage member 80 and the storage member 90 provided so as to hold the frame 70 therebetween, and the resiliently deformable partition member 71 is fixed to the frame 70. Therefore, the toner cartridge 30B has a simple structure, and can be assembled in a simple manner. In other words, the toner cartridge 30B is simple in structure and easy to manufacture. Further, the toner cartridge 30B exhibits a high sealing performance.

For example, in a conventional toner cartridge in which a partition member is inserted into a cylindrical container as disclosed in Japanese Patent No. 4086547, it is necessary to provide a gap between the partition member and the cylindrical container to allow the partition member to be inserted into the cylindrical container.

In contrast, the toner cartridge 30B of this embodiment can be manufactured by stacking the storage member 80, the frame 70 (to which the partition member 71 is fixed) and the storage member 90, and by fixing the storage member 80, the frame 70 and the storage member 90 to each other at contact portions (i.e., fixing portions FP1, FP2 and FP3) by a single process such as heat welding or the like. Therefore, a complex assembling process is unnecessary. Further, gaps between any two of the storage member 80, the frame 70 (to which the partition member 71 is fixed) and the storage member 90 can be reduced.

Further, in the configuration where the partition member is inserted into the cylindrical container as disclosed by the above described patent, the partition member is needed to have a strength so as to withstand an inserting operation into the cylindrical container. In contrast, according to the image forming apparatus of this embodiment, the partition member is not needed to have such a strength. Therefore, a thickness of the partition member can be reduced.

Modifications

Although the embodiment of the present invention has been described, the present invention is not limited to the embodiment, but various modification can be made. For example, although the image forming apparatus of the above described embodiment forms a color image, the present invention is also applicable to an image forming apparatus that forms a monochrome image such as, for example, a black toner image. Further, although the image forming apparatus of the above described embodiment employs a direct transfer system in which a developer image is directly transferred to a recording medium, the present invention is also applicable to an image forming apparatus employing an intermediate transfer system in which a developer image is transferred to a recording medium via an intermediate transfer body.

Figure 18:
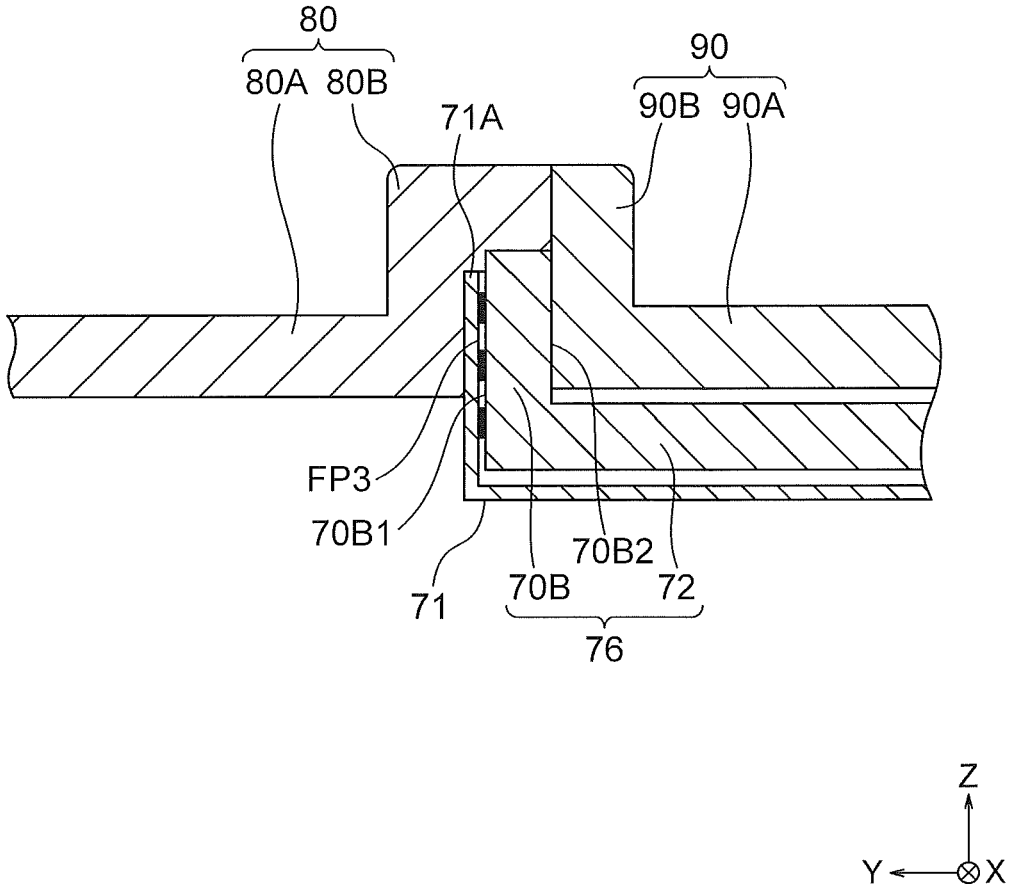
FIG. 18 is an enlarged sectional view showing a part of a toner cartridge according to a modification of the embodiment of the present invention.

Further, in the above described embodiment, the peripheral end portion 71A of the partition member 71 is fixed to the outer frame 72 (i.e., a part different from the flange 70B) of the frame 70. However, the present invention is not limited to such a configuration. FIG. 18 shows a modification of this embodiment. A frame 76 shown in FIG. 18 includes the flange 70B having the surface 70B1 contacting the flange 80B of the storage member 80. In this modification, the peripheral end portion 71A of the partition member 71 is fixed to the surface 70B1 of the flange 70B. In this case, the fixing portion FP3 overlaps with a portion where the flange 80B of the storage member 80 and the flange 90B of the storage member 90 face each other. Therefore, an effective area (i.e., a deformable area) of the partition member 71 can be increased.

Further, although the image forming apparatus of the above described embodiment includes the LED head as the exposing device, it is also possible to employ other exposing devices such as a laser element or the like.

Further, the image forming apparatus of the above described embodiment has a printing function. However, the present invention is also applicable to, for example, an MFP (Multi-Function Peripheral) having, for example, a scanning function and a facsimile function in addition to the printing function.

While the preferred embodiments of the present invention have been illustrated in detail, it should be apparent that modifications and improvements may be made to the invention without departing from the spirit and scope of the invention as described in the following claims.

What is claimed is:

1. A developer storage body comprising:

a first storage member including a first opening and a first flange provided along an outer periphery of the first opening;

a second storage member including a second opening, and a second flange provided along an outer periphery of the second opening so that the second flange faces the first flange;

a frame including a third flange sandwiched by the first flange and the second flange; and a resiliently deformable partition member including a peripheral end portion fixed to the frame, wherein the partition member and the first storage member form a first space portion therebetween, and the partition member and the second storage member form a second space portion therebetween.

2. The developer storage body according to claim 1, wherein the third flange protrudes outward from an outer surface of the frame.

3. The developer storage body according to claim 1, wherein the partition member resiliently deforms according to a volume of a first developer stored in the first space portion and a volume of a second developer stored in the second space portion.

4. The developer storage body according to claim 1, wherein the peripheral end portion of the partition member is fixed to a portion of the frame different from the third flange.

5. The developer storage body according to claim 1, wherein the peripheral end portion of the partition member is fixed to the third flange.

6. The developer storage body according to claim 1, wherein the first storage member includes a first main body on which the first opening is formed, and wherein the second storage member includes a second main body on which the second opening is formed.

7. An image forming unit comprising:

the developer storage body according to claim 1;

an image bearing body that bears a latent image on a surface thereof;

a developer bearing body that bears a developer and develops the latent image on the surface of the image bearing body; and a developer supply member that supplies the developer to the developer bearing body.

8. An image forming apparatus comprising:

the image forming unit according to claim 7; and a medium feeding unit that feeds a medium to the image forming unit.

9. A developer storage body comprising:

a first storage member including a first opening and a first flange provided along an outer periphery of the first opening;

a second storage member including a second opening, and a second flange provided along an outer periphery of the second opening so that the second flange faces the first flange;

a frame including a third flange held between the first flange and the second flange; and a resiliently deformable partition member including a peripheral end portion fixed to the frame, wherein the partition member and the first storage member form a first space portion therebetween, and the partition member and the second storage member form a second space portion therebetween;

wherein the first flange includes a step portion including a first contact surface and a third contact surface retracted from the first contact surface;

wherein the second flange includes a second contact surface that contacts the first contact surface; and wherein the second contact surface and the third contact surface face each other via the third flange inserted therebetween.

10. The developer storage body according to claim 9, wherein the first contact surface and the second contact surface are welded to each other.

11. The developer storage body according to claim 9, wherein a gap between the first contact surface and the third contact surface is substantially the same as a thickness of the third flange.

12. The developer storage body according to claim 11, wherein the second contact surface is welded to both of the first contact surface and the third flange.

13. A developer storage body comprising:

a first storage member including a first opening and a first flange provided along an outer periphery of the first opening;

a second storage member including a second opening, and a second flange provided along an outer periphery of the second opening so that the second flange faces the first flange;

a frame including a third flange held between the first flange and the second flange; and a resiliently deformable partition member including a peripheral end portion fixed to the third flange of the frame, wherein the partition member and the first storage member form a first space portion therebetween, and the partition member and the second storage member form a second space portion therebetween.

14. The developer storage body according to claim 13, wherein the third flange protrudes outward from an outer surface of the frame.

15. The developer storage body according to claim 13, wherein the partition member resiliently deforms according to a volume of a first developer stored in the first space portion and a volume of a second developer stored in the second space portion.

16. The developer storage body according to claim 13, wherein the first flange includes a step portion including a first contact surface and a third contact surface retracted from the first contact surface;

wherein the second flange includes a second contact surface that contacts the first contact surface; and wherein the second contact surface and the third contact surface face each other via the third flange inserted therebetween.

17. The developer storage body according to claim 16, wherein a gap between the first contact surface and the third contact surface is substantially the same as a thickness of the third flange.

18. The developer storage body according to claim 13, wherein the first storage member includes a first main body on which the first opening is formed, and wherein the second storage member includes a second main body on which the second opening is formed.

19. An image forming unit comprising:

the developer storage body according to claim 13;

an image bearing body that bears a latent image on a surface thereof;

a developer bearing body that bears a developer and develops the latent image on the surface of the image bearing body; and a developer supply member that supplies the developer to the developer bearing body.

20. An image forming apparatus comprising:

the image forming unit according to claim 19; and a medium feeding unit that feeds a medium to the image forming unit.

* * * * *